US005269024A

United States Patent [19]

Wyatt

[11] Patent Number: 5,269,024

[45] Date of Patent: Dec. 14, 1993

[54] SURGICAL CAP AND MASK

[76] Inventor: Christine Wyatt, 2540 S. Crystal Lake Dr., Lakeland, Fla. 33801

[21] Appl. No.: 919,145

[22] Filed: Jul. 23, 1992

[51] Int. Cl.[5] ..... A42B 1/06

[52] U.S. Cl. ..... 2/173; 2/200.1; 2/901

[58] Field of Search ..... 2/9, 171, 173, 174, 2/185 R, 196, 199, 203, 206, 209.1, 424, DIG. 7; D29/7, 8; 128/201.22, 201.23, 201.25, 206.13, 206.19, 206.27, 207.11, 863

[56] References Cited

U.S. PATENT DOCUMENTS

| | | | |
|---|---|---|---|
| 911,433 | 2/1909 | Pachner | 2/195 |
| 3,307,202 | 3/1967 | Schuessler | 2/173 |
| 3,838,467 | 10/1974 | Zientara | 2/173 |
| 3,885,558 | 5/1975 | Belkin | 2/173 |
| 4,032,991 | 7/1977 | Vandeweghe | 2/173 |
| 4,084,585 | 4/1978 | Venaleck | 128/206.13 |
| 4,180,868 | 1/1980 | Snow | 2/203 |
| 4,572,173 | 2/1986 | Comeau | 2/DIG. 7 |
| 4,589,408 | 5/1986 | Singer | 2/173 |
| 4,671,271 | 6/1987 | Bishop | D29/7 |
| 4,805,639 | 2/1989 | Dial | 2/410 |
| 5,067,174 | 11/1991 | Ritchey | 2/171 |
| 5,109,548 | 5/1992 | Balaban | 2/173 |

*Primary Examiner*—Clifford D. Crowder
*Assistant Examiner*—Diana L. Biefeld
*Attorney, Agent, or Firm*—Dominik, Stein, Saccocio, Reese, Colitz & Van Der Wall

[57] ABSTRACT

A one piece garment constructed for use in a health care environment and the like. The garment includes a major portion positionable over the head of the wearer, the major piece having a forward edge positionable across the forehead of the wearer and rearward edge positionable across the back of the head of the wearer. The garment also includes a minor portion positionable over the face of the wearer, the minor piece having an upper edge positionable beneath the eyes and above the nose of the wearer and a lower edge positionable across the throat of the wearer. The major and minor portions are joined to form ear openings therebetween and to also form a neck opening between the rearward edge of the major portion and the lower edge of the minor portion, and to also form an eye opening between the forward edge of the major portion and the upper edge of the minor portion.

6 Claims, 3 Drawing Sheets

SURGICAL CAP AND MASK

BACKGROUND OF THE INVENTION

1. Summary of the Invention

This invention relates to a surgical cap and mask and, more particularly, to a one piece garment constructed for use in a health care environment and the like, the garment including a major portion positionable over the head of the wearer and a minor portion positionable over the face of the wearer, the major and minor portions being joined to form ear openings therebetween and to also form a neck opening and an eye opening.

2. Description of the Background Art

There is an ever continuing need for increased cleanliness and sterility in and around health care facilities. It has long been the practice for the physicians, nurses and other people at health care facilities to wear sterilized apparel either directly or over the normal apparel. Such sterilized apparel provides protection against the transmission (giving or receiving) of germs, viruses or the like.

For many years, cloth garments have been utilized and then washed after each use in an effort to facilitate such protection. It has been found in recent years, however, that sterilized paper or other material, disposable and biodegradable is better suited for these purposes, both from a health stand point as well as from an economic standpoint. Such disposable products are readily sealed hermetically after fabrication and opened immediately prior to use, preferably in a sterilized room, for maximizing the safety to patient as well as physicians, nurses and other health care people.

Various garments have been designed, commercialized, and utilized and patented for covering the majority of the head and/or face of the health care people. Such garments frequently utilized a cap for covering the hair and adjacent head areas in combination with a mask which is tied around the back of the wearer's head to filter the breathing of the wearer. Unfortunately, time and effort is needed in putting on and taking off such garments. Various other devices have also been made in a one-piece configuration covering various parts of the anatomy. Prior to applicant's invention hereof, none has ever been constructed to maximize the safety and comfort while minimizing cost and inconvenience.

In the ever increasing effort to improve head coverings for health care facilities, a wide variety of designs have been generated and a large number of patents have been issued. By way of example, consider U.S. Pat. Nos. 911,433 to Pachner and 3,307,202 to Schuessler. Neither of these garments is constructed and designed to make them suitable for use in health care environments. Other garments are known in the prior art which provide protective head covering arrangements for use in health environments. Four such garments are disclosed in U.S. Pat. Nos. 3,885,558 to Belkin; 4,589,408 to Singer; 4,805,639 to Dial and 4,032,991 to Vandeweghe. These garments cover the complete head of the wearer and, as such, are not combination cap and mask arrangements. Additionally, U.S. Pat. No. 5,067,174 to Ritchey illustrates a combination headgear and face mask for use in a health environment. However, the face mask and headgear are interconnected only by way of a visor. As such, the Ritchey headdress is not of a construction for maximum benefits. Lastly, Bishop is U.S. Pat. No. 4,671,271 illustrates a protective facial mask which covers the oral and nasal cavities. The mask, as such, provides no head covering structure.

As evidenced by the above referred to patents, as well as other commercial garments, a wide variety of garments have been designed for covering of the head and facial regions of a wearer, and efforts are continuously being made in an attempt to improve surgical head coverings. None, however, provides the benefits, advantages and objectives of the present invention which employs sterile sheet material gathered, stitched and rendered resilient in certain key areas to maximize the cleanliness, comfort, convenience and utility with maximum coverage of a wearer's head while minimizing the cost and inconvenience which were prevalent in the garments of the prior art. No prior patent or commercial garment is directed to a one piece cap and mask combination garment for use in a health care environment in the manner intended herein.

By making the garment, as disclosed in the instant application, sufficiently large in the area covering the hair and chin, a common size garment will accommodate people with greater or lesser quantities of hair either on the head, face or chin of the wearer without excessive encumbrances. Further, the fullness of the garment in the chin area allows the pulling down of the elastic edge thereabove to a location adjacent to the chin for rendering speaking more intelligible by the wearer. This is very critical in a health care setting such as an operating room. Similarly, the openings for the ears and eyes allow for the maximum utilization of the eyes and ears of the wearer as required by physicians and nurses when, for example, an operation is being performed.

The prior art masks of the type that are tied from behind have tendencies to restrict the nose and mouth of the wearer thereby providing a feeling of smothering as well as garbling the words when the wearer attempts to speak. The particular design of the present invention with the gathering and stitching of resilient members renders material above the nose in proper position so that the problem of drooping of this portion of the material below the nose or mouth is no longer a problem. Additionally, uncomfortable and inconvenient pins had previously been used to hold the material in this area adjacent the upper part of the nose to preclude the drooping of the fabric to beneath the nose and mouth.

Accordingly, it is an object of the present invention to provide a one piece garment constructed for use in a health care environment and the like, the garment including a major portion positionable over the head of the wearer, the major piece having a forward edge positionable across the forehead of the wearer and rearward edge positionable across the back of the head of the wearer; and a minor portion positionable over the face of the wearer, the minor piece having an upper edge positionable beneath the eyes and above the nose of the wearer and a lower edge positionable across the throat of the wearer, the major and minor portions being joined to form ear openings therebetween and to also form a neck opening between the rearward edge of the major portion and the lower edge of the minor portion, and to also form an eye opening between the forward edge of the major portion and the upper edge of the minor portion.

It is a further object of the present invention to maximize coverage of a wearer's head in a health care environment.

It is a further object of the present invention to utilize sterile, disposable garments in a facility dispensing health care.

Lastly, it is an object of the present invention to speed up the donning and removal of head covering garments.

The foregoing has outlined some of the more pertinent objects of the present invention. These objects should be constructed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown on the attached drawings. For the purpose of summarizing the invention, the invention may be incorporated into a one piece cap and mask combination garment constructed for use in a health care environment and the like, the garment including a major piece of biodegradable material, the major piece being positionable over the head of the wearer, the major piece having a convex forward edge positionable across the forehead of the wearer and a convex rearward edge positionable across the back of the head of the wearer, the major piece also having similarly shaped essentially parallel side edges coupling the forward and rearward edges to form a generally square configuration, each side edge including parallel linear sections with a centrally disposed concave section positionable over an ear of the wearer, tucks formed along the forward and rearward edges and at the center of each concave section, and an elastic band around the entire periphery of the major piece a minor piece of biodegradable material, the minor piece being positionable over the face of the wearer, the minor piece having an elongated upper edge positionable beneath the eyes and above the nose of the wearer and an elongated lower edge positionable across the throat of the wearer, the minor piece also having similarly shaped short side edges coupling the elongated forward and rearward edges to form a generally rectangular configuration, each side edge including linear sections with a centrally disposed concave section positionable beneath the ear of the wearer, a tuck formed along the forward and rearward edges and at the center of each concave section, and an elastic band along the majority of the extent of the elongated upper and lower edges of the minor piece; and stitching coupling the linear sections of the minor piece with the linear sections of the major piece to form partially elastic ear openings therebetween and to also form an elastic neck opening between the rearward edge of the major piece and the lower edge of the minor piece, and to also form an elastic eye opening between the forward edge of the major piece and the upper edge of the minor piece.

The invention may also be incorporated into a one piece garment constructed for use in a health care environment and the like, the garment including a major portion positionable over the head of the wearer, the major piece having a forward edge positionable across the forehead of the wearer and rearward edge positionable across the back of the head of the wearer; and a minor portion positionable over the face of the wearer, the minor piece having an upper edge positionable beneath the eyes and above the nose of the wearer and a lower edge positionable across the throat of the wearer, the major and minor portions being joined to form ear openings therebetween and to also form a neck opening between the rearward edge of the major portion and the lower edge of the minor portion, and to also form an eye opening between the forward edge of the major portion and the upper edge of the minor portion.

The garment further includes tucks formed along the forward and rearward edges and an elastic component around the periphery of the major portion. The garment further includes tucks formed along the upper and lower edges and an elastic component along the majority of the extent of the upper and lower edges of the minor portion. The major and minor pieces may be fabricated of disposable, biodegradable material or of washable fabric material.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent methods and structures do not depart from the spirit and scope of the invention as set forth in the appended claims.

DESCRIPTION OF THE DRAWINGS

Shown in the various drawings is a device for carrying out the principles of the present invention.

Similar reference numerals refer to similar parts throughout the various drawings.

DETAILED DESCRIPTION OF THE INVENTION

Figure 1:
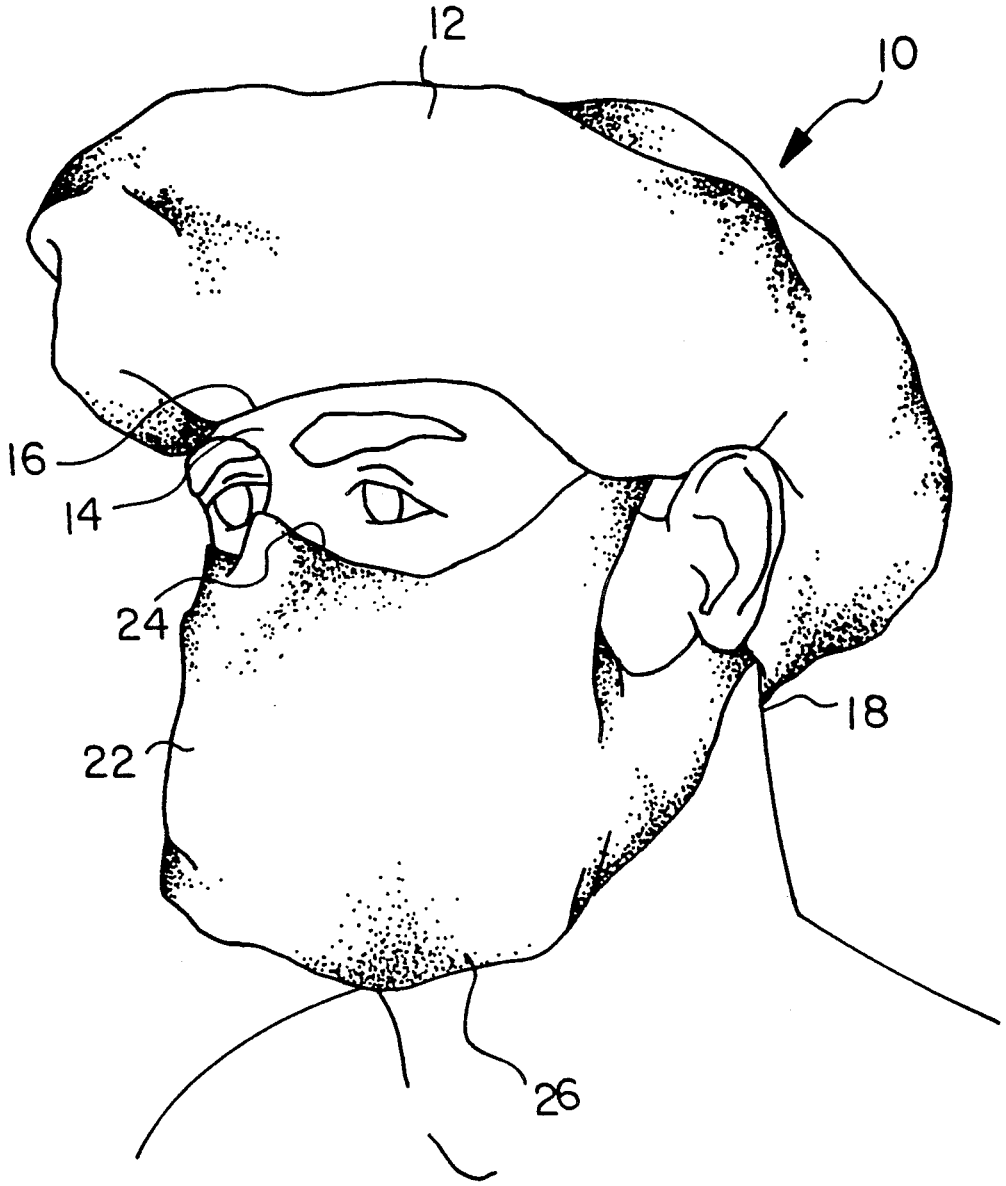
FIG. 1 shows a health care worker wearing the cap and mask combination garment of the presentation.
Figure 2:
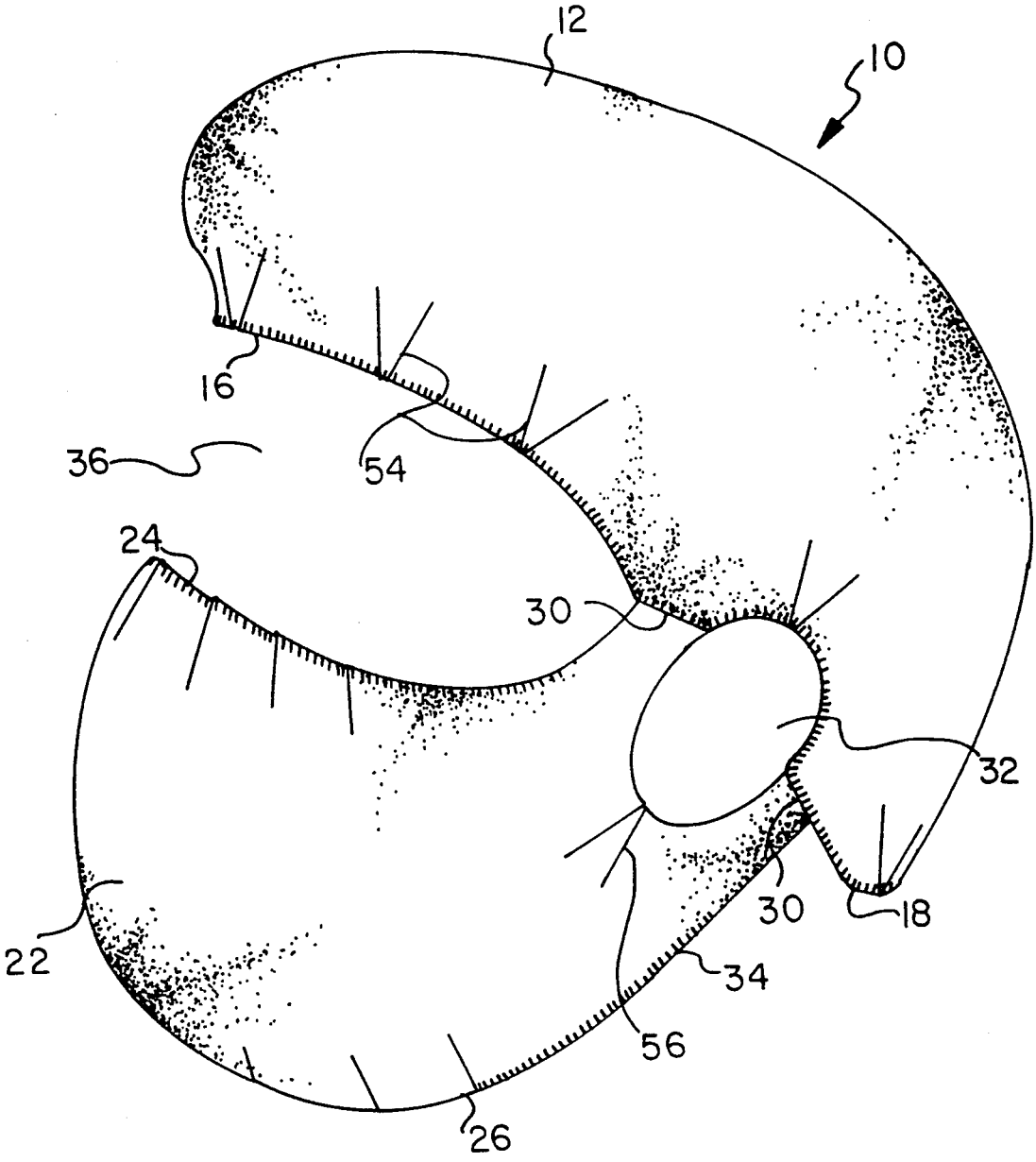
FIG. 2 is side elevational view of the garment shown in FIG. 1.
Figure 3:
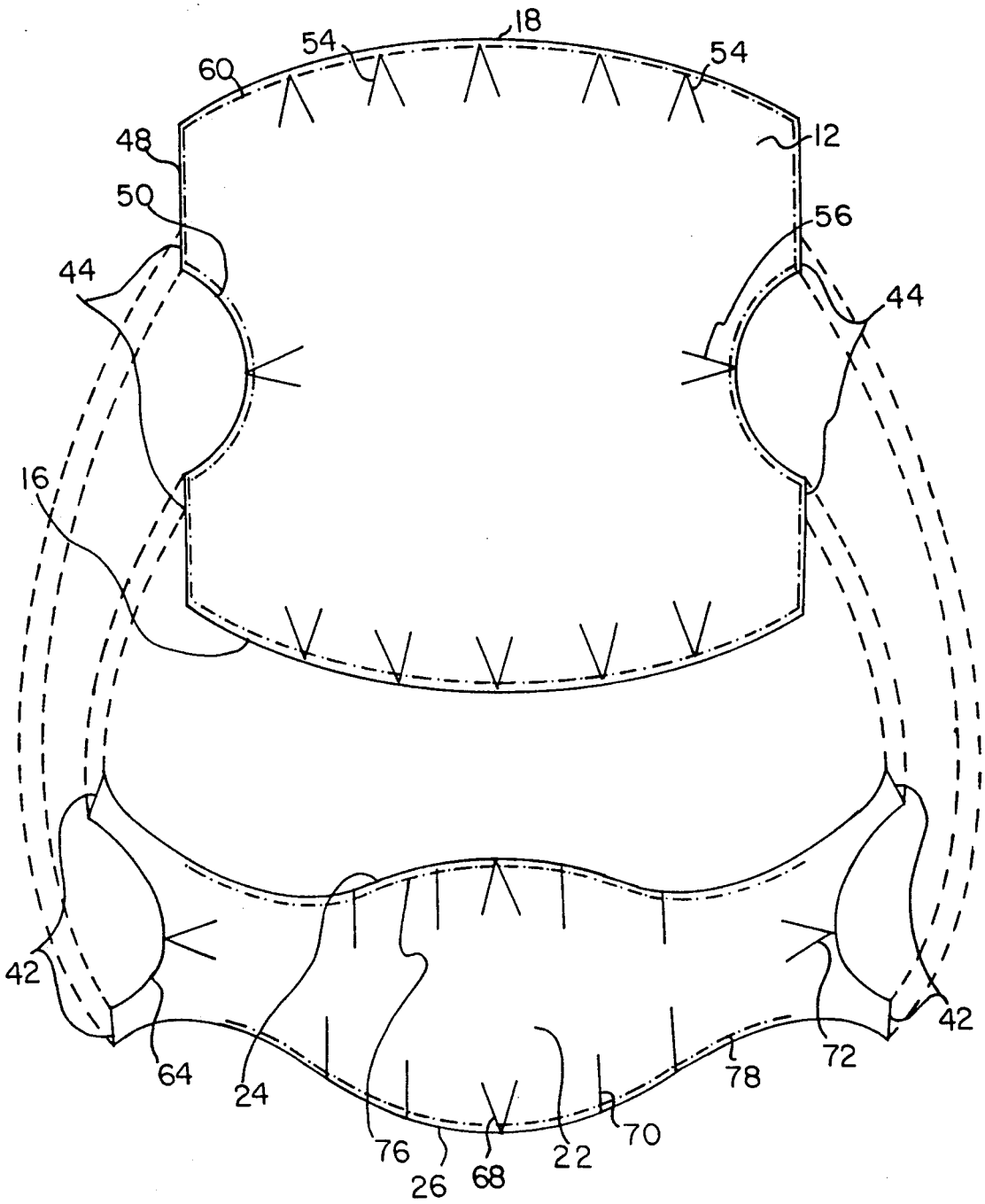
FIG. 3 is a plan view of the component sheets of material of the garment of the prior figures.

Shown in the various drawings, with particular reference to FIGS. 1 and 2, the present invention is illustrated as a cap and mask combination garment 10 particularly constructed for use in a health care environment. The garment 10 includes a major piece or portion 12 positionable over the head of the wearer 14. The major portion has a forward edge 16 positionable across the forehead of the wearer and a rearward edge 18 positionable across the back of the head of the wearer. The garment also includes a minor piece or portion 22 positionable over the face of the wearer. The minor portion has an upper edge 24 positionable beneath the eyes and above the nose of the wearer and a lower edge 26 positionable across the throat of the wearer. The major and minor portions are joined as by stitching 30 to form ear holes or openings 32 therebetween and to also form a neck opening 34 between the rearward edge of the major portion and the lower edge of the minor portion, and to also form an eye opening 36 between the forward edge of the major portion and the upper edge of the minor portion.

The garment is preferably constructed from a major piece 12 and minor piece 22. The major piece 12 is formed from a flexible sheet material that is positionable over the head of the wearer, and the minor piece 22 is formed from a flexible sheet material that is positionable over the face of the wearer. The major and minor pieces are interconnected by way of four linear sections 42 and 44, two on either side of the garment. These two sets of linear sections serve to form the ear holes 32 of the garment. The results of the construction as just described is a single garment that serves as a combination cap and a mask garment 10. This unitary structure eliminates the need to purchase, wear and store two separate garments.

The major piece of material is a unique design to facilitate its placement over the head of the wearer. The major piece includes a convex forward edge 16 to fit across forehead of the wearer and a convex rearward edge 18 to fit across the back of the head of the wearer at the upper part of the neck. Interconnecting the forward and rearward edges are two similarly shaped parallel side edges 48. Centrally disposed along each side edge is a concave section 50. These concave sections 50 are designed to be positionable over the ears of the wearer. Furthermore, extending from both sides of the concave sections are parallel linear sections 44. These parallel linear sections are designed to extend down past both sides of the ear.

In order to enable the major piece 12 to accommodate a wide variety of wearers, v-shaped tucks 54 are incorporated at various locations around its periphery. Specifically, five tucks are incorporated into each of the convex edges, and one tuck 56 is incorporated into each of the concave sections. Additionally, in order to ensure the resiliency of the major piece in its fit upon the head, an elastic band 60 is sewn around the entire periphery of the major piece 12 with the material gathered to increase its ability to accommodate larger or smaller heads. The gathering, tucks, elastic and stitching allow the major piece to fit snugly over heads of various sizes while accommodating essentially any over heads of various sizes while accommodating essentially any quantity of hair.

The construction of the minor piece 22 is of a unique design to facilitate its placement over the lower facial region of the wearer. As with the major piece, the minor piece is preferably constructed from a biodegradable material. The minor piece includes an elongated upper edge 24 which is positionable beneath the eyes and above the nose of the wearer and an elongated lower edge 26 which is positionable over the throat of the wearer. The minor piece 22 also includes similarly shaped short side edges 42 which couple the elongated upper and lower edges 24 and 26. Centrally disposed along each of the side edges are concave sections 64. The concave sections of the minor piece are designed for placement under the ears of the wearer. Furthermore, extending from either side of both of the concave sections are parallel linear sections 42. The linear sections which extend from the minor piece are coupled, by stitching 30, to the linear sections of the major piece adjacent to the concave sections 50. Thus, the linear sections serve to form ear openings 32 for the garment 10.

In order to insure the proper fit of the minor piece around the face of the wearer v-shaped tucks 68 and linear darts 70 are formed at various locations around its periphery. Specifically, one tuck and four symmetrically located darts are incorporated in each of the elongated edges, and one tuck 72 is incorporated into each of the concave sections 64. Additionally, in order to insure the resiliency of the minor piece in its fit over the face, elastic bands 76 and 78 are is sewn along the majority of the central extent of the upper and lower edges 24 and 26 with the material gathered to increase its ability to accommodate larger or smaller heads. The gathering, tucks, darts, elastic and stitching allow the minor piece to fit snugly over faces of various sizes while accommodating essentially any quantity of moustaches, beards or other facial hair.

The elastic and stitching of the major and minor pieces cooperate in such a manner as to provide a snug but comfortable neck opening in between the rearward edge of the major piece and the lower edge of the minor piece. Additionally, a snug but comfortable eye opening is formed in between the forward edge of the major piece and the upper edge of the minor piece.

The garment is fabricated of flexible sheet material, such as paper or other biodegradable material, natural or synthetic, and which is preferably biodegradable and capable of being sterilized. The garment may also be fabricated of cloth, knitted or woven, in which case the garment would be cleaned and sterilized between uses for repeated wearing.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A one piece cap and mask combination garment constructed for use in a health care environment, the garment including:

a major piece of bidodegradable material, the major piece being positionable over the head of the wearer, the major piece having a convex forward edge positionable across the forehead of the wearer and a convex rearward edge positionable across the back of the head of the wearer, the major piece also having similarly shaped essentially parallel side edges coupling the forward and rearward edges to form a generally square configuration, each side edge including parallel linear sections with a centrally disposed concave section positionable over an ear of the wearer, tucks formed along the forward and rearward edges and at the center of each concave section, and an elastic band around the entire periphery of the major piece;

a minor piece of biodegradable material, the minor piece being positionable over the face of the wearer, the minor piece having an elongated upper edge positionable beneath the eyes and above the nose of the wearer and an elongated lower edge positionable across the throat of the wearer, the minor piece also having similarly shaped short side edges coupling the elongated upper and lower edges to form a generally rectangular configuration, each side edge including linear sections with a centrally disposed concave section positionable beneath the ear of the wearer, a tuck formed along the forward and rearward edges and at the center of each concave section, and an elastic band along the majority of the extent of the elongated upper and lower edges of the minor piece; and stitching coupling the linear sections of the minor piece with the linear sections of the major piece to form partially elastic ear openings therebetween and to also form an elastic neck opening between the rearward edge of the major piece and the lower edge of the minor piece, and to also form an elastic eye opening between the forward edge of the major piece and the upper edge of the minor piece.

2. A one piece garment constructed for use in a health care environment, the garment including:

a major portion positionable over the head of the wearer, the major portion having a forward edge positionable across the forehead of the wearer and a rearward edge positionable across the back of the head of the wearer, the major portion having first regions forming upwardly extending recesses for the upper parts of a wearer's ears;

a minor portion positionable over the face of the wearer, the minor portion having an upper edge positionable beneath the eyes and above the nose of the wearer and a lower edge positionable across the throat of the wearer, the minor portion having second regions forming downwardly extending recesses for the lower parts of a wearer's ears; and means coupling the major and minor portions to form ear openings through the cooperable positioning of the first and second regions and to also form a neck opening between the rearward edge of the major portion and the lower edge of the minor portion, and to also form an eye opening between the forward edge of the major portion and the upper edge of the minor portion.

3. The garment as set forth in claim 2 and further including tucks formed along the forward and rearward edges and an elastic component around the periphery of the major portion.

4. The garment as set forth in claim 2 and further including tucks formed along the upper and lower edges and an elastic component along the majority of the extent of the upper and lower edges of the minor portion.

5. The garment as set forth in claim 2 wherein the major and minor pieces are fabricated of disposable, biodegradable material.

6. The garment as set forth in claim 2 wherein the major and minor pieces are fabricated of washable fabric material.

* * * * *